US005711492A

United States Patent [19]

Cheladze

[11] Patent Number: 5,711,492

[45] Date of Patent: Jan. 27, 1998

[54] COMPOSITE MACHINE ELEMENTS FROM FIBER REINFORCED POLYMERS AND ADVANCED WEAR CERAMICS

[75] Inventor: George Andre Cheladze, Hillside, N.J.

[73] Assignee: T.P.L. Products, Inc., Morristown, N.J.

[21] Appl. No.: 273,006

[22] Filed: Jul. 8, 1994

[51] Int. Cl.[6] ..... B02C 18/18

[52] U.S. Cl. ..... 241/220; 241/291; 241/300

[58] Field of Search ..... 241/242, 291, 241/294, 300, 220; 407/32, 118, 119

[56] References Cited

U.S. PATENT DOCUMENTS

| | | | |
|---|---|---|---|
| 4,135,847 | 1/1979 | Hemmings | 407/32 X |
| 4,546,929 | 10/1985 | Fritsch et al. | 241/294 |
| 4,759,248 | 7/1988 | Muller et al. | 83/349 |
| 4,930,710 | 6/1990 | Hench | 241/294 |
| 5,114,082 | 5/1992 | Brundiek | 241/121 |
| 5,203,513 | 4/1993 | Keller et al. | 241/30 |
| 5,232,316 | 8/1993 | Tennutti | 407/23 |
| 5,269,477 | 12/1993 | Buchholtz et al. | 241/293 |

*Primary Examiner*—John M. Husar
*Attorney, Agent, or Firm*—Lerner, David, Littenberg, Krumholz & Mentlik

[57] ABSTRACT

Tooling parts such as cutting knives, bearings, gears and the like are constructed from advanced wear ceramics and fiber reinforced polymer material. The cutting knives are constructed from a plurality of ceramic blades molecular bonded or embedded in a support of reinforced polymer material. The resulting cutting blades are light in weight, inert to chemical attack, and maintain their sharpness during the processing of various materials such as plastics, wood, paper, cardboard and the like.

30 Claims, 7 Drawing Sheets

COMPOSITE MACHINE ELEMENTS FROM FIBER REINFORCED POLYMERS AND ADVANCED WEAR CERAMICS

BACKGROUND OF THE INVENTION

The present invention relates in general to innovative new composite products manufactured from reinforced polymers and advanced wear ceramics. More specifically, the present invention is directed to fiber reinforced polymer and advanced wear ceramic composites formed into a variety of products, for example, industrial tooling, e.g., knives, blades, slitting elements, hand tools, etc.; machine parts and tools, e.g., bearings, gears, shafts, etc.; consumer products, e.g., razor blades, household cutting implements, etc.; and surgical instruments/medical instruments and the like.

There is a large variety of engineering materials available for use in manufacturing different products. The key to success of any product is the selection of the right material of construction, taking into consideration the intended function and operation of the product. To this end, there is known the construction of products from such materials as ferrous metals, non-ferrous metals, metal alloys, natural materials such as stone, rubber, wood and the like, ceramics, and reinforced and non-reinforced polymers. The number of specific materials within these groups are exhaustive, not to mention their extensive potential combinations.

Material selection has been found acutely important in the plastic industry where significant problems are incurred during manufacture and recycling of various plastic materials. The plastic industry is losing millions of dollars by using tooling made of steel, carbide and other metals and alloys. During the manufacture and recycling of consumer/industrial plastic products, the tooling, e.g., blades and knives, tend to lose their sharpness creating unwanted heat problems, and other operational difficulties. This has affected the ability of most manufacturing and recycling facilities to operate to their fullest potential. For example, it is known to employ cryogenic cooling during plastic material processing, which expectedly, is undesirably expensive to install and operate.

Today's machine tooling typically needs a great deal of unwanted attention. For example, currently used tooling, as a result of material selection, frequently need constant replacement and/or maintenance. This can result in significant downtime and lost productivity. Downtime is an industrial/consumer products manufacturer's biggest burden because it is the main cause of lost production, and hence, profitability. During downtime, employees are non-productive, the manufacturing lines stop producing product for long periods of time, all while the tooling undergoes the time consuming process of replacement or maintenance such as resharpening. It can be appreciated that many machine tooling, e.g., blades and knives, are not responding to the manufacturer's needs. In all, the machine tool's useful life can be very limited, and therefore, costly to the manufacturer.

Many industries, and in particular the plastic industry, are in demand for machine tools that retain certain characteristics during operation, while eliminating other characteristics that are deleterious to their intended function and operation. In manufacturing machinery for the plastic industry, it has been difficult to maintain efficient production due to the inadequacies of the industry's current technology with respect to material selection for use in machine tools. Accordingly, there is an unsolved need in the industrial processing industry for the development of new engineering materials and composites thereof for machine parts and tools such as blades, knives, and the like.

In Muller, et al., U.S. Pat. No. 4,759,248, there is known the construction of a composite metal and ceramic bed knife for granulating plastic strands. The bed knife cooperates with a rotating metal cutting blade attached to a rotating rotor to effect granulation therebetween. The bed knife is constructed of individually aligned ceramic sections which are fastened to a metal support beam by means of a screw and metal holding bar longitudinally received within a recess formed within each ceramic section. Although a ceramic bed knife of this type overcomes certain of the disadvantages inherent with known machine tools, such construction and material combination still possesses a number of disadvantages. For example, the use of a metal support beam and metal cutting blade act as heat sinks which retain significant heat generated during the granulation process by the rotating cutting blade. This heat build-up often requires the use of expensive cryogenic cooling to prevent the undesirable agglomeration of the processed plastic material. Furthermore, the method of attaching the ceramic bed knife to the support beam is both cumbersome to implement and expensive to manufacture. Hence, there remains an unsolved need for machine tools and the like for use in the industrial processing industry which are constructed from new engineering composite materials, e.g., those possessing high strength and fracture resistance, low friction and wear coefficients, high resistance to abrasive wear in the most hostile operating environments, as well as being relatively inert to chemical attack, non-corrosive, etc.

SUMMARY OF THE INVENTION

Broadly, it is one object of the present invention to provide machine parts and tools for use in the industrial process industry constructed from new engineering composite materials such as reinforced polymers and advanced wear ceramics.

Another object of the present invention is to provide machine parts and tools which are constructed from relatively inert materials with respect to their operating environment, e.g., chemically non-reactive.

Another object of the present invention is to provide machine tools in the nature of a stationary ceramic bed knife and rotary fly knife constructed from composite fiber, carbon reinforced polymers and advanced wear ceramics.

Another object of the present invention is to provide machine tools of composite reinforced polymers and advanced wear ceramics which have a longer life span, require less force when used as a cutting tool and better reliability.

Another object of the present invention is to provide machine parts and tools for processing recyclable plastic materials for subsequent reuse in commercial processes such as thermoforming, injection molding, extrusion, die casting and the like.

In accordance with one embodiment of the present invention, there is provided a composite cutting device comprising a rigid support of polymer material, and a cutting blade of ceramic material having a body supporting portion and a cutting edge portion, the body supporting portion secured to the support.

In accordance with another embodiment of the present invention there is provided an apparatus for cutting material, the apparatus comprising a housing; a rotor rotatably mounted within the housing; at least one first cutting device attached to the rotor for rotation therewith, the first cutting device comprising a rigid support of polymer material and a cutting blade of ceramic material having a body supporting portion and a cutting edge portion, the body supporting portion secured to the support; and at least one second cutting device supported within the housing opposing the first cutting device, the second cutting device comprising a rigid support of polymer material and a cutting blade of ceramic material having a body supporting portion and a cutting edge portion, the body supporting portion secured to the support, the cutting edge portion of the first cutting device spaced from the cutting edge portion of the second cutting device to provide a cutting zone therebetween.

In accordance with another embodiment of the present invention there is provided a cutting apparatus comprising a rotatable cutting device, the cutting device including a circular cutting blade of ceramic material secured to a support therefore of polymer material, and means for rotating the cutting device.

In accordance with another embodiment of the present invention there is provided a composite machine element comprises a rigid support of polymer material shaped into a desired machine element, and a layer of ceramic material secured to the support at a location operative of the machine element.

In accordance with another embodiment of the present invention there is provided a composite cutting device comprising a first rigid support of reinforced polymer material, the first support having a plurality of projections extending therefrom, and a cutting blade of ceramic material including a body supporting portion having a plurality of openings therein and a cutting edge portion, the body supporting portion arranged on the first support wherein the projections are received within the openings, and a rigid second support of reinforced polymer material bonded to the first rigid support and the projections extending through the openings, whereby the cutting blade is embedded between the first and second rigid supports which form an integral body of reinforced polymer material.

In accordance with another embodiment of the present invention, there is described a method of attaching ceramic cutting blades to fiber composite material by injecting resin material directly into a mold having a slot provided for receiving at least a portion of the cutting blade. Once the resin is pre-pegged/cured and pressed, the cutting blade will be firmly held within the resin material.

BRIEF DESCRIPTION OF THE DRAWINGS

The above description, as well as further objects, features and advantages of the present invention will be more fully understood with reference to the following detailed description of composite machine elements from fiber reinforced polymers and advanced wear ceramics, when taken in conjunction with the accompanying drawings, wherein:

FIG. 1 is a diagrammatic illustration, in partial cross-section, of a rotary grinder or turbo mill for use in a phasing system for various materials such as paper, cardboard, wood, virgin and recyclable plastics and the like;

DETAILED DESCRIPTION OF THE PREFERRED EMBODIMENTS

Figure 1:
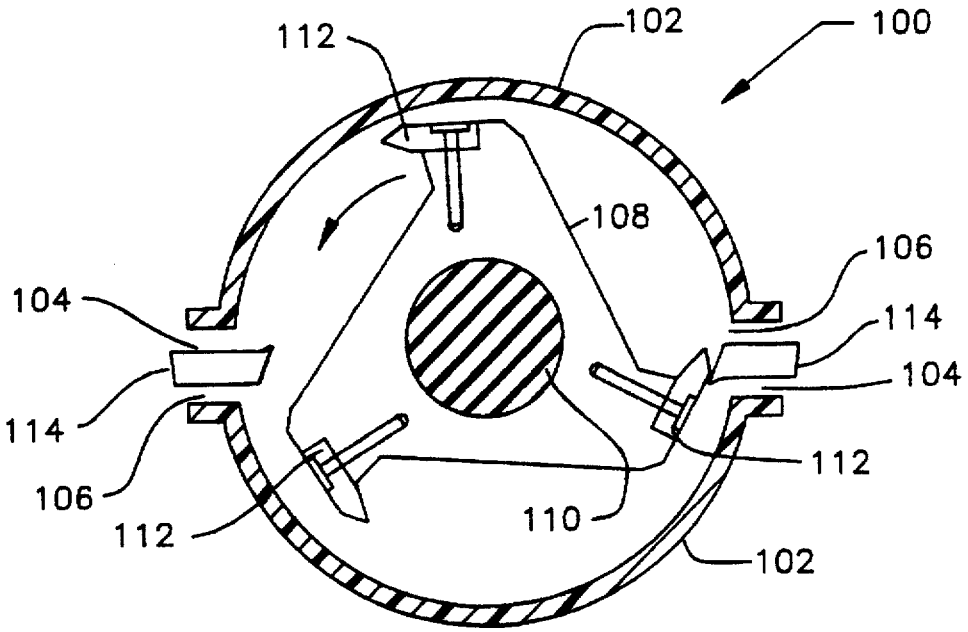

Referring now to the drawings, wherein like reference numerals represent like elements, there is shown in FIG. 1 a diagrammatic illustration of a rotary grinder or turbo mill generally designated by reference numeral 100 for use in a system for processing various materials such as paper, cardboard, wood, virgin and recyclable plastics and the like. The apparatus 100 includes a housing 102 provided with one or more material inlets 104 and material outlets 106. A rotor 108 is rotatably supported within the housing 102 about a rotatable shaft 110. A plurality of fly knives 112 are releasably secured to circumferential portions of the rotor 108. Although the embodiment illustrates three such fly knives 112, it is to be understood that a greater or lesser number may be provided. One or more stationary bed knives 114 are positioned circumferentially about the housing 102 extending to a location in operative association with the fly knives 112 as to be described hereinafter. Briefly, the spatial arrangement between the fly knives 112 and bed knives 114 form a cutting zone therebetween for the material being processed. The apparatus 100 as thus far described is merely one embodiment of the use of fly knives 112 and bed knives 114 for processing various materials pursuant to the present invention, such as cutting, grinding, pulverizing, shredding, granulating and the like.

Figure 2:
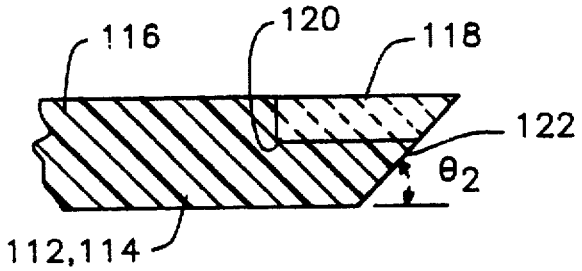
FIG. 2 is a cross-sectional view of a composite cutting device constructed in accordance with one embodiment of the present invention.

Referring now to FIG. 2, there is broadly illustrated one example of a machine tooling part in the nature of a cutting device, and specifically, a fly knife 112 or bed knife 114 for use in the plastics industry. The knives 112, 114 are constructed from a rigid support 116 and a forward cutting blade 118. The support 116 can be constructed from a variety of synthetic polymer materials which posses the desired properties for their intended application, and preferably those commonly referred to as reinforced polymer materials using known resin transfer molding. Resin transfer molding is a composite molding process which utilizes dry reinforcement materials, closed molds, injection of liquid resin, and chemical reaction curing to produce a rigid composite matrix component. Resin transfer molding can be considered an intermediated volume molding process. Pre-cut mat/fabric patterns or formed preforms of reinforcing material are placed into a properly released and sealed mold, the mold is closed and clamped, and resin injected into the mold under pressure. Vents are provided about the perimeter of the mold to permit bleeding of air and resin from the reinforcement. The resin is allowed to cure, the part demolded, trimmed and finished. Reinforcement materials used in the process for the support 116 are preferably graphite or carbon products, however, in some non-critical cases, fiberglass products are also useful.

Generally, the fiberglass materials are provided in a dry form of woven or knitted fabrics, continuous or chopped strand mats, and gun roving. For the application of fiberglass with the resin transfer molding process, E-glass and S-2 type grades are preferred. Fiberglass offers chemical resistance (except to hydrofluoric and hot phosphoric acids), dimensional stability (E-glass C.T.E. averages per °F., $2.8\times10^{-6}$), good thermal properties, high tensile strength, high thermal endurance, low moisture absorption, and outstanding electrical insulation.

Graphite reinforcement products are available in dry form of woven and knitted fabrics, stitched unidirectional, and tow. Graphite is one of the strongest and stiffest reinforcements available and, hence are preferred. In addition to the high strength-to-weight and stiffness-to-weight ratios, carbon fibers are thermally and electrically conductive, have very low C.T.E. and excellent fatigue resistance. It is, however, to be understood that other known reinforcement materials may be used in manufacturing the support 116 for use in the apparatus 100, as either a fly knife 112, bed knife 114 or the like pursuant to the present invention.

The preferred resin systems are polyester, vinyl ester, epoxy, toughened epoxy, and bismaleimide. Polyester resin systems offer the flexibility of tailoring the system to meet a particular application for performance, cure cycle, etc. These resins can be filled and pigmented, and generally are chemically activated using less than 5% by weight peroxide catalyst. Cure is by chemical reaction, generally at room temperature. Service temperature of polyester is less than about 150° F.

Vinyl ester resin systems are slightly tougher than the polyesters, and offer added corrosion and UV protection, as well as fire resistance. Like the polyesters, the chemistry of vinyl esters can be tailored to fit the application, can be filled and pigmented, and the curing mechanism is similar to polyesters in that they can be cured at room or at slightly elevated temperature. Service temperature of vinyl esters is slight above 200° F.

Epoxy resin systems are higher performance systems than the polyester or vinyl ester resin systems. Epoxies require a larger percentage of curing agent or catalyst, i.e., 25 to 30%, and are room temperature curable, but elevated heat cure up to 350° F. is preferred to enhance physical properties. Service temperature of epoxies range from 200° F. to 275° F. Toughened epoxies and bismaleimide resins offer the highest performance and are therefore the most preferred in combination with fiberglass reinforcement for construction of the support 116. Typical service temperature for toughened epoxy is 300° F. and up to 400° F. for bismaleimide. Higher temperature resin systems are available to provide operating temperature into the 500° F. (phenolic-triazine) to 800° F. (polymide) range.

It is therefore to be understood that other known resins may also be used in manufacturing the support 116 for use in the apparatus 100 pursuant to the present invention as either a fly knife 112, bed knife 114 or the like. It is also contemplated that the resin system itself may include fillers such as glass or ceramic fibers or powders blended into the resin to provide additional stiffness and strength to the overall composite. For example, an epoxy resin system may be enhanced by blending into the resin glass or ceramic powders and pouring the resulting mixture over the aforementioned reinforcing materials such as fiberglass or graphite knitted fabrics and the like. The resulting composite reinforced material will possess the requisite strength and stiffness for functioning as a support 116 for the ceramic cutting blade 118.

The cutting blade 118 can be constructed from a variety of ceramics which provided increased resistance to metal buildup, no material agglomeration in processing plastics or other materials, are inert to chemical attack and eliminate heat build-up. There is generally known a number of ceramics which have the aforementioned properties, as well as outstanding mechanical properties. These ceramics have shown to outperform tungsten carbide in wear and resistance to agglomeration and metal pickup. These ceramics are generally referred to as advanced wear ceramics which are available from a number of sources. The main advantages of using ceramics for the cutting blades 118 are their low coefficient of friction-anti-galling, chemical inertness-reduces galling, abrasion resistance-edge sharpness/ retention, and toughness and corrosion resistance-longer life expectancy. In all, ceramic cutting blades 118 have resistance to abrasive wear in the most hostile operating environments, posses high strength and fracture toughness, low friction and wear coefficients.

Useful advanced wear ceramics, include, for example, Yttria stabilized zirconia (Y-TZP) which is available in two forms, (1) from chemically derived powders: White ceramic, 0.4 micron grain size, transformation toughened, and (2) from fused zirconia alloyed with Yttria: Color depends on purity of zirconia. YZ-110 is yellow, 0.8 micron grain size. Both of these materials have excellent strength and toughness. Zr $O^2$ has a much lower density [5.9 g/cc than tungsten carbide (14 g/cc)], but higher than $Al^2O^3$ (4.0 g/cc) or $Si^3N4th$(3.2 g/cc). A disadvantage is its low thermal conductivity which can sometimes cause hot spots to form by friction leading to induced wear under high loads and velocities. The outstanding transformation toughness of these ceramics allows for easier machining, avoiding subsurface damage.

One problem associated with Y-TZP has been low temperature degradation. However, it is known to make Y-TZPs which are virtually immune from this degradation. For example, a modified alumina zirconia ceramic material (YZ-110 HS) is available from Norton Advanced Ceramics, Export, Pa. YZ-110 HS shows better results due to its properties and is the preferred ceramic material for machine tooling such as cutting blades 118 and the like.

Magnesia stabilized zirconia (Mg-PSZ) have greater toughness than Y-TZPs but lower strength. This does not exclude them for use as tooling such as cutting blades 118 and the like, but they are more vulnerable to transformation under stress and have a lower hardness than the Y-TZPs. In addition, they have very large grain size and high volume fraction of closed porosity (3%) which makes them less desirable than Y-TZP.

Alumina with zirconia (ZTA) as a minor phase was first developed as a cutting tool about 10 years ago. If the zirconia particles are less than 0.5 microns, then the tetragonal phase can be retained in the ZTA. Alternatively, the zirconia particles may be stabilized with Yttria or ceria etc., as well as by small grain size. Uniform mixtures of zirconia and alumina are usually achieved by colloidal processing, producing microstructure with grain sizes of about 1 micron. ZTA's combination of strength, toughness, thermal conductivity, lower density and greater hardness enables their suitability for machine tooling applications.

R-Tuff is a composite material of alumina and SiC whiskers commercially developed by Advance Composite Materials Corporation. This material can be either hot pressed or hot isostatic pressed. It has experienced utility as a cutting tool with limited utility for machine parts. However, if blanks are made from inhomogeneous mixtures of $Al^2O^3$ and SiC whiskers, then the strength is reduced below acceptable levels.

Silicone nitride is a well developed material covering various compositions. Its outstanding combination of properties has made it desirable for use in ceramic bearings, cutting tools, and heat engine applications. So far, silicon nitride has not been proven for certain applications in the aluminum industry. For example, the machining of aluminum metal with silicon nitride cutting tools is impossible because of galling. Higher toughness materials have been developed in so called insitu composites which extends the useful range of these ceramics. For high strength, hot pressing or hot isostatic pressing has most often been used but now silicon nitrides are being developed without this practice. Silicone nitride is difficult and expensive to fabricate into a finished tool. Sialon, a variant of silicon nitride with outstanding physical properties, is well established in cutting tools and more recently as engine valves and metal forging dies.

Cermets can, in principal, be used for tool/machine parts but high metal content may be prone to agglomeration and metal pick-up. Those like tungsten carbide with little metal bond could be alternatives, such as the Kyocera TC 30 based on titanium carbonitride. Even with very large pores, it is resistant to metal pick-up.

Given the large selection of available advanced wear ceramics, the merits of different materials and processes to make knife/blades, tools, machinery parts, medical products, industry/consumer products, hereinafter referred as tool/products, will now be compared. Specific applications may require specific ceramic materials. In this respect, the tool/product's material is merely a part of the manufacturing process. Changes in other parts of the system, e.g., a new lubricant may create new opportunities and/or problems in material selection. Ideally, one would like to promote synergy. However, because of the complexity and the incomplete understanding of all materials and their behavior in use, one cannot accurately predict the outcome of the competition between different materials in use within a given system or application.

Considering the various ceramics that can be used for tool/products, their physical properties while being important, do not tell the whole story. Undoubtedly, there is the necessary strength and toughness, but there are less definable parameters associated with wear, agglomeration and metal pick-up. For example, porosity and surface roughness must be minimized to prevent agglomeration, metal pick-up and the scoring of the tool/product. This requires hot isostatic pressing to remove porosity (±0.5%) and machining/CNC to provide an Ra of 0.025 to 0.050 microns (1–2 micro inches) or less depending on the application. A flexure strength of 100 Ksi (700 MPa) is considered adequate, but one needs to be aware of flaws in the larger volume of the tool/product. There is some evidence that finer grain size may be preferred to minimize wear in ceramics.

In order for a ceramic material to replace tungsten carbide it will have to satisfy a number of the following factors:

1. Longer tool/product life.
2. Corrosion resistant.
3. Equal or improved quality of finish.
4. Cost effectiveness.
5. Lower mass, creating less mechanical stress.
6. Agglomeration inert.
7. Chemically inert.
8. Elimination of frictional heat, (heat resistant).
9. Reduced tendency for metal pick-up.
10. Synergistic improvements.

Historically, tools/products for the industrial/consumer markets have been made from tungsten carbide. Tungsten carbide and other metals/alloys are extremely adaptable in demanding wear applications. However, none have the sensitive and crucial characteristics highly demanded by the industry. Tungsten carbide has been successful with its high strength, rigidity, and high thermal conductivity with toughness greater than some ceramics and hardness greater than some metals. Moreover, it can be machined and polished to produce the necessary dimensions and quality of finish required in tool/products.

Because of the corrosion/wear of the cobalt phase by the use of lubricants, nickel is widely used in tool/products. Even so, the corrosion problem persists. Another problem with tungsten carbide is its tendency to agglomerate material during the manufacturing process due to frictional heat. Once agglomerated, the whole manufacturing process stops, resulting in major financial losses, specifically tool-sharpening costs, production setbacks, and employee productivity. Further, tungsten carbide has an unwanted characteristic of continuously picking up aluminum and other metals/alloys. This necessitates halting of production lines to either clean or replace the tool/products. Finally, as well established as tungsten carbide is, it is less likely to be dramatically changed in the near future than some of the new emerging ceramics. YZ-110 HS is considered to have the same and more desirable/demanded characteristics. Therefore, YZ-110 HS is considered the preferred ceramic to replace tungsten carbide, and other metal/alloy markets for tool/products.

There will now be briefly described the manufacturing technology that will affect the alumina/zirconia tool/machinery parts. Many of the operations of the process are similar to the technology used to produce tungsten carbide tool/machinery parts.

Tool/machine part blank manufacturing is based on a toughened oxide ceramic. A transformation toughened zirconium oxide and zirconia toughened alumina (YZ-110 HS) has been previously described. In production quantities, fused crude material is very inexpensive compared to chemically derived material. This process produces a tool material with excellent physical properties from relatively impure starting raw materials. The fused grain is reduced to powder (about 5 microns) formed by a hydrothermal degradation process referred to as autoclave process. This process consists of treating the fused grain in a pressure vessel at an elevated temperature and pressure to take advantage of the low temperature degradation characteristics. The autoclaved material is then attritor milled to submicron size in an aqueous solution, spray dried with a binder and physically sized by a screening process (about 0.5 microns).

Powders are consolidated by die pressing or cold isostatic pressing prior to green machining. The green turned parts require hot isostatic pressing to reliably achieve the required balance of properties from the currently available ceramic powders. Binder removal and pre-sintering are conducted in periodic electric furnaces. Final densification is performed on site where tolerances of 0.1 mm are maintained through the densification step. Superabrasive grinding methods are used to generate the high precision tool/machine parts.

Referring once again to FIG. 2, the support 116 is constructed as an elongated member having a rectangular recess 120 formed along one edge thereof. The cutting blade 118, also constructed as an elongated rectangular member, is received in the recess 120. The cutting blade 118 may be secured to the support 116 in a variety of manners. For example, suitable adhesives may be used, and more preferably, what is referred to as polymer/molecular bonding which requires the application of heat and pressure.

The end face of knife 112, 114 may be arranged at an angle to limit interference of the support 116 during use of the knife, as well as exposing the cutting blade 118 to the material being processed. By way of one example, the angle of end face 122 is set at approximately 60° to horizontal. In the embodiment shown, knife 112, 114 is considered to have a neutral angle of attack. That is, knife 112, 114 is arranged in a horizontal orientation so as to be generally perpendicular to the orientation of an opposing knife (not shown) which defines a cutting zone therebetween.

Figure 3:
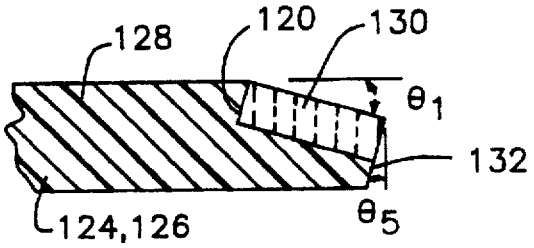
FIG. 3 is a cross-sectional view of a composite cutting device constructed in accordance with another embodiment of the present invention.

Referring now to FIG. 3, there is shown another embodiment of a fly knife 124 or bed knife 126 constructed from a support 128 and a cutting blade 130 arranged to have a negative angle of attack. In this regard, the cutting blade 130 is arranged at a negative angle in the range of 5°–10° from horizontal, while having an end face 132 arranged at approximately 15° to vertical. Generally, it is preferred to have the bed knife 126 provided with a negative angle of attack to minimize impact against the cutting blade 130 during rotation of the opposing fly knife.

Figure 4:
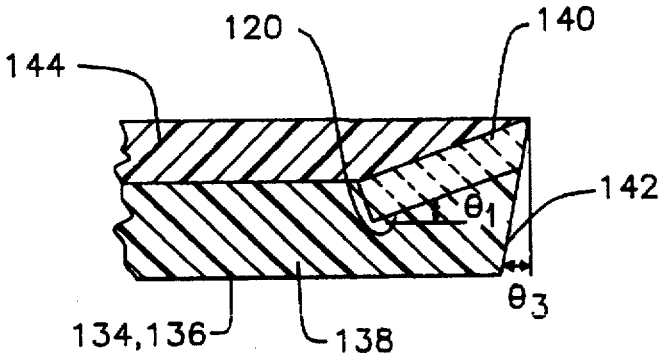
FIG. 4 is a cross-sectional view of a composite cutting device constructed in accordance with another embodiment of the present invention.
Figure 5:
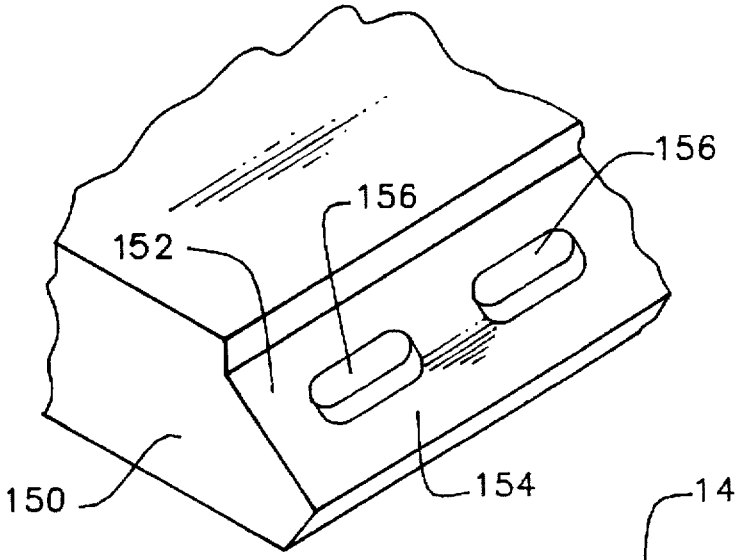
FIG. 5 is a perspective view of a rigid support of polymer material constructed for securing a cutting blade of ceramic material thereto in accordance with the preferred embodiment of the present invention.

Referring now to FIG. 4, there is shown another embodiment of a fly knife 134 or bed knife 136 constructed from a support 138 having a cutting blade 140 arranged at a positive angle of attack. Similar to knife 124, 126, knife 134, 136 has the cutting blade 140 arranged at a positive angle in the range of from about 5°–10° to horizontal, and an end face arranged at approximately 15° to vertical.

Knife 134, 136 is also provided with a protective outer layer 144. The protective layer 144 may be constructed from a variety of materials, such as similar materials as used for the construction of the support 138. In this regard, the protective layer 144 can be molecular bonded to the support 138 or secured by application of a suitable adhesive. In addition, the protective layer 144 may be formed by coating with ceramic material of the aforementioned types. The protective layer 144 protects the surface of the support 138 from impact by the material being processed during operation of the apparatus 100. In the case were the protective layer 144 is of polymer material, an outer coating of ceramic material can be applied encasing the entire support 138 as a protective coating against abrasion, chemical attack and the like.

As thus far described, the cutting blade 118, 130, 140 may be secured to the support 116, 128, 138 by a variety of techniques such as polymer/molecular bonding, or the like. In accordance with the preferred embodiment, the cutting blade 118, 130, 140 is secured by embedding same in the support 116, 128, 138 as more clearly shown in FIGS. 5–8. In this regard, an elongated linear cutting blade 146 is provided in one or more segments thereof with a plurality of spaced openings 148. The openings 148 may be in a variety of shapes, such as circular, oval, rectangular or the like. The support 150 is provided with a recess 152 having a bottom surface 154 from which there projects a plurality of spaced apart projections 158 sized and shaped to be received within corresponding openings 148 within the cutting blade 146.

Figure 7:
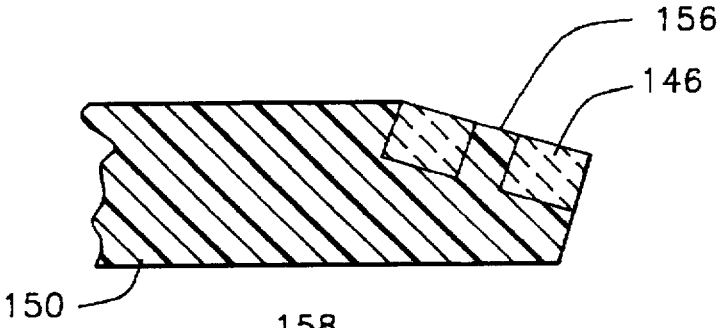
FIGS. 7 and 8 are cross-sectional views of an assembled composite cutting device constructed in accordance with the preferred embodiment of the present invention using the support and cutting blade as shown in FIGS. 5 and 6.
Figure 8:
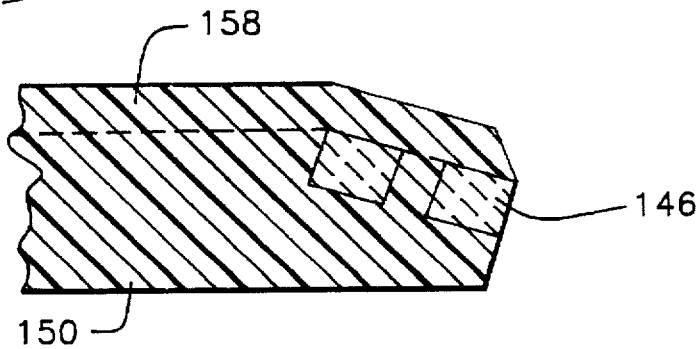

The cutting blade 146 is positioned within the recess 152 so as to receive the projections 156 within the openings 148 as shown in FIG. 7. A secondary layer 158 is provided over the surface of the support 150 and a portion of the cutting blade 146 as shown in FIG. 8. Specifically, the secondary layer 158 may be constructed from the same reinforced polymer material as the support 150 and preformed using a mold into the desired shape. The secondary layer 158 and the support 150 are bonded together using molecular bonding to form an integral one piece unit. As such, the projections 156 are integrally joined to the secondary layer 158 thereby embedding the cutting blade 146. In addition, the cutting blade 146 may be provided with a notched opening (not shown) communicating with the openings 148 along the rear edge thereof to enable introduction of synthetic resin material when molding the secondary layer 158.

In accordance with another embodiment of the present invention, the ceramic cutting blades can be attached to the fiber composite material by injecting resin material directly into a mold having a slot provided for receiving at least a portion of the cutting blade. Once the resin is pre-pegged/ cured and pressed, the cutting blade will be firmly held within the resin material.

Figure 9:
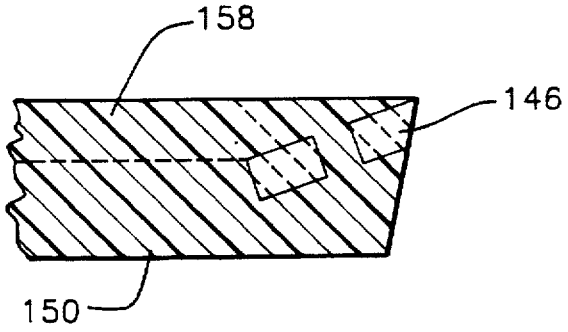
FIG. 9 is a cross-sectional view of another embodiment of a composite cutting device constructed in accordance with the preferred embodiment of the present invention generally using the support and cutting blade as shown in FIGS. 5 and 6.

In the event it is required to replace the cutting blade 146, the protective secondary layer 158 may be removed such as by milling or the like. As shown in FIG. 8, the cutting blade 146 is arranged having a negative angle of attack. A cutting blade 146 having a positive angle of attack is shown in FIG. 9. In this regard, the cutting blade 146 is embedded between the support 150 and secondary layer 158 in a similar manner as thus far described.

Although the aforementioned fastening technique for the cutting blade 146 has been described with reference to the support 150 having a plurality of projections 156, it is to be understood that these projections may be eliminated. In this regard, the secondary layer 158 may be provided as a flowable polymer material which, under heat and pressure, will fill the openings 148 within the cutting blade 146, while at the same time, bonding to the underlying support 150. In this regard, the materials for the secondary layer 158 and the support 150 may be the same, which is preferable, or different as desired.

Figure 10:
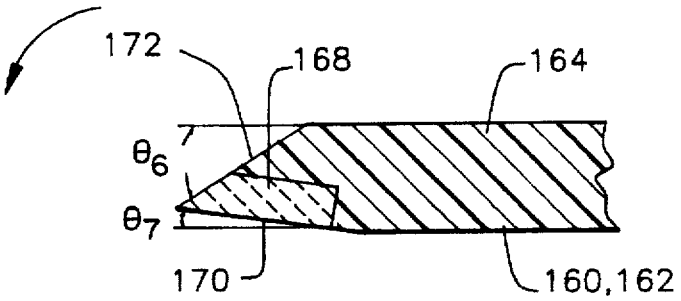
FIG. 10 is a cross-sectional view of a composite cutting device constructed in accordance with another embodiment of the present invention.
Figure 11:
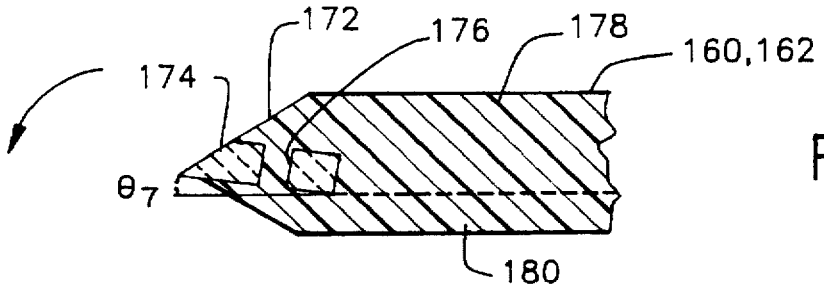
FIG. 11 is a cross-sectional view of a composite cutting device constructed in accordance with the preferred embodiment of the present invention generally using the support and cutting blade as shown in FIGS. 5 and 6.

Referring now to FIGS. 10 and 11, there is disclosed another embodiment of a fly knife 160 or bed knife 162. The knife 160, 162 of FIG. 10 is provided with a support 164 having a recess 168 arranged at approximately 15° to horizontal. Received within the recess 168 is a cutting blade 170 which is molecular bonded to the support 164. The knife 160, 162 has its face 172 arranged at an angle of approximately 60° to horizontal.

As shown in FIG. 11, the cutting blade 174 is provided with a plurality of openings 176 so as to be embedded between a support 178 and secondary layer 180 as previously described with respect to the embodiment disclosed in FIGS. 5–8. The knife 160, 162 shown in FIGS. 10 and 11 are preferred use as a fly knife having a direction of rotation as illustrated by the arrow whereby the cutting blade 170, 174 has a negative angle of attack with respect to an opposing bed knife (not shown).

Figure 6:
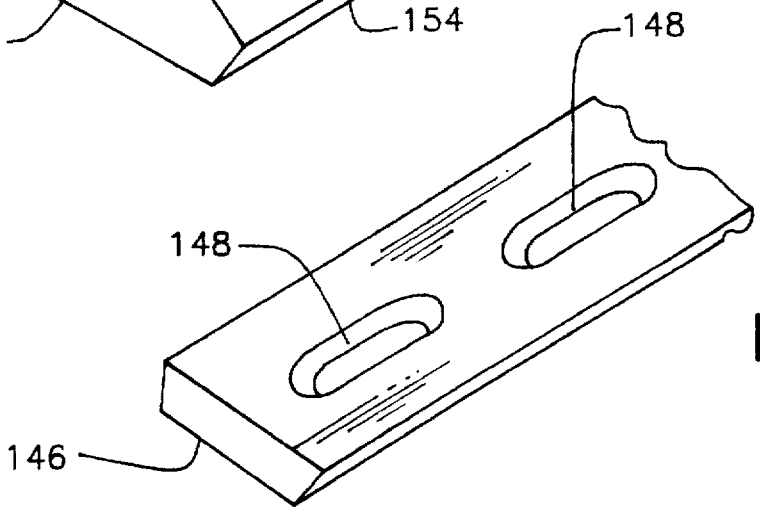
FIG. 6 is a perspective view of a cutting blade of ceramic material adapted to be secured to the support shown in FIG. 5.
Figure 12:
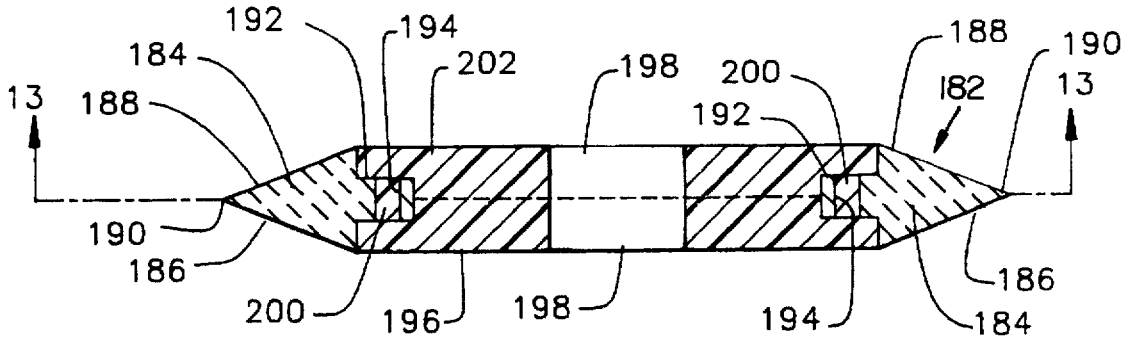
FIG. 12 is a cross-sectional view of a composite cutting device in the nature of a circular disc constructed in accordance with another embodiment of the present invention.
Figure 13:
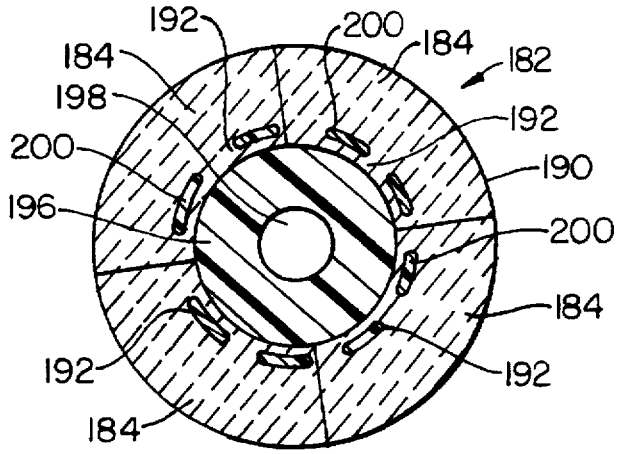
FIG. 13 is a cross-sectional view taken along line 13—13 in FIG. 12 showing the composite cutting device constructed of a plurality of individual segments.

Referring now to FIGS. 12 and 13, there will be described the construction of a segmented rotary cutting knife generally designated by reference numeral 182. The cutting knife 182 may be used in a variety of applications, for example, cutting paper, metal, wood, steel, etc. The knife 182 is constructed from a plurality of curved cutting blade segments 184 which are assembled in the form of a disc. Each of the segments 184 include a pair of sloping sidewalls 186, 188 terminating at a circumferential cutting edge 190. Each of the segments 184 include a projecting rib 192 having a plurality of spaced apart openings 194. In this respect, it will be appreciated that each of the segments 184 are constructed in a similar manner as the cutting blade 146 as shown in FIG. 6.

The cutting knife 182 is assembled in a similar manner as described with respect to the embodiment disclosed in FIGS. 5–8. Specifically, a first disk-shaped support 196 is formed by molding so as to include a central opening 198 and a plurality of circumferentially arranged upstanding projections 198 to be aligned with the openings 194 in each of the segments 184. A second disk-shaped support 202 also having a central opening 198 is molecular bonded to the first disk-shaped support 196, and hence to the projections 200 so as to embed the ribs 192 of the cutting blade segments 184 therein. The cutting knife 182 may be constructed from any number of cutting blade segments 184. In the event one of the segments 184 becomes damaged during use, it may be readily replaced upon removal of the second disk-shaped support 202 such as by milling and the like.

The composite cutting knives of the present invention are light in weight, but mechanically strong due to a support of reinforced polymer material and a cutting blade of advanced wear ceramics. As a result of this composite construction, no heat is generated during application of the cutting knives which would otherwise interfere with the materials being processed. In addition, the cutting knives are chemically inert and may be used for both wet and dry processing of materials. The cutting blades by virtue of their construction from advanced wear ceramics, retain their edge and can be resharpened using a diamond wheel if necessary. This construction of a cutting knife pursuant to the present invention overcomes the disadvantages inherent from the use of tool steel cutting blades. For example, tool steel cutting blades frequently require resharpening as the cutting edge will roll during use. These blades, if improperly hardened, will break or crack and are subject to chemical attack by PVC materials and other chemicals which are found in conventional plastics which are being processed. Further, heat generated during the cutting process, especially when the blade gets dull from edge roll, will cause undesirable agglomeration of the plastic material being processed. Hence, the composite cutting knives of the present invention are far superior to any cutting knife heretofore known.

Figure 14:
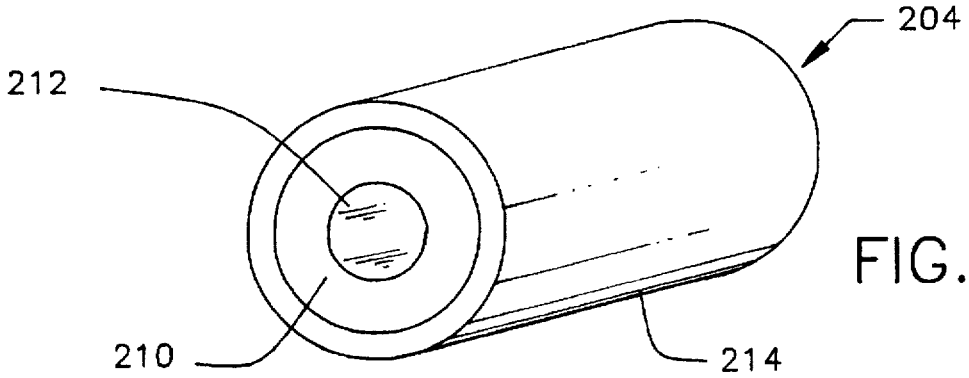
FIG. 14 is a perspective view of a machine element in the nature of a bearing constructed in accordance with the present invention.
Figure 15:
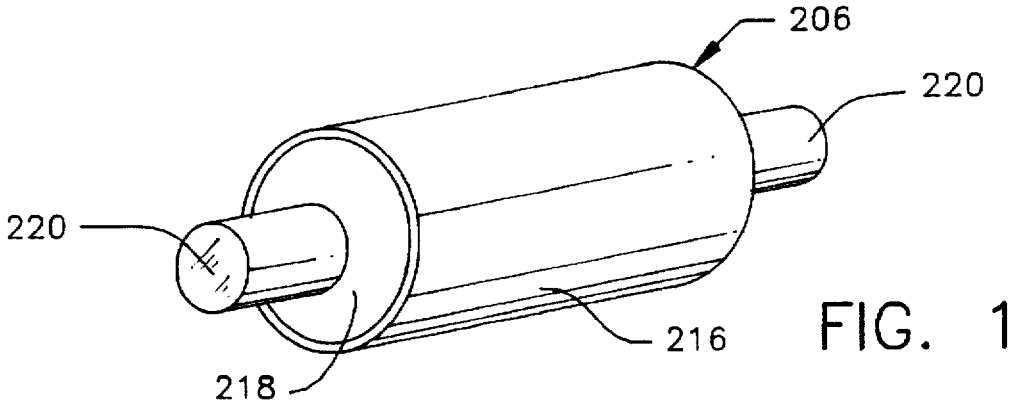
FIG. 15 is a perspective view of a machine element in the nature of a shaft constructed in accordance with the present invention.
Figure 16:
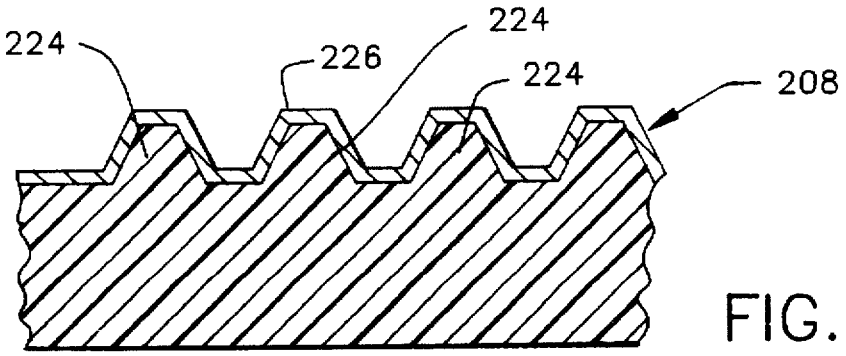
FIG. 16 is a partial cross-sectional view of a machine element in the nature of a gear constructed in accordance with the present invention.

These advantages, for example, chemical inertness, mechanical strength, light in weight, resulting from the use of advanced wear ceramics and fiber reinforced polymers can be employed in other tool/machine parts. For example, as shown in FIGS. 14–16, these materials can be used to construct a bearing 204, a shaft 206, a gear 208 or the like. The bearing 204 as shown in FIG. 14 is constructed from a cylinder 210 of reinforced polymer material having a longitudinal bore 212 extending therethrough. The outer surface of the cylinder 210 is provided with a layer 214 of advanced wear ceramic material. The ceramic layer 214 may be constructed as a hollow shell with the cylinder 210 being press fit therein and molecular bonded thereto. Alternatively, the ceramic layer 214 may be applied using known plasma spray techniques to build up a sufficient layer of ceramic material.

Referring to FIG. 15, the shaft 206 is constructed in a similar manner to the bearing 204. In this regard, a ceramic layer 216 in the nature of a hollow shell is molecular bonded to the outer surface of a cylinder 218 of reinforced polymer material. Alternatively, the ceramic layer 216 can be applied by plasma spray techniques. The cylinder 218 may be integrally formed with extending rods 220 or provided with same as a metal rod extending through a bore of the cylinder 218. Referring to FIG. 16, the gear 208 is constructed from a support 222 of fiber reinforced polymer material having its outer surface in the shape of a plurality of teeth 224. The outer surface of the teeth are coated with a layer of ceramic material 226 such as by plasma spraying or by molding same into a shell and molecular bonding to the support 222. The tool/machine parts, for example, the bearing 204, shaft 206, and gear 208, possess the same attributes of the cutting knives as previously described which are constructed from the combination of advanced wear ceramics and reinforced polymer materials. These tool/machine parts are adapted to be used as replacement parts for conventional metal tool/machine parts which possess the above noted disadvantages.

Figure 17:
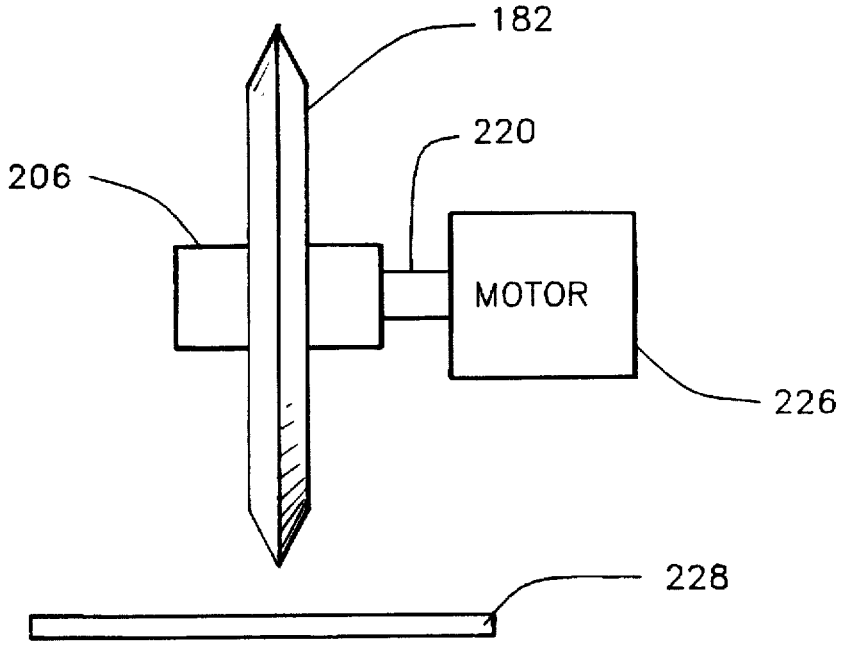
FIG. 17 is a diagrammatic illustration of a circular cutting apparatus in accordance with the present invention.

Referring now to FIG. 17, there is shown a circular cutting apparatus 225. The apparatus 225 includes a circular cutting knife 182 mounted onto a shaft 206 for rotation by a motor 226. The cutting knife 182 is positioned overlying a material support table 228. Rotation of the cutting knife 182 will effect cutting of materials provided on the table 228.

Figure 18:
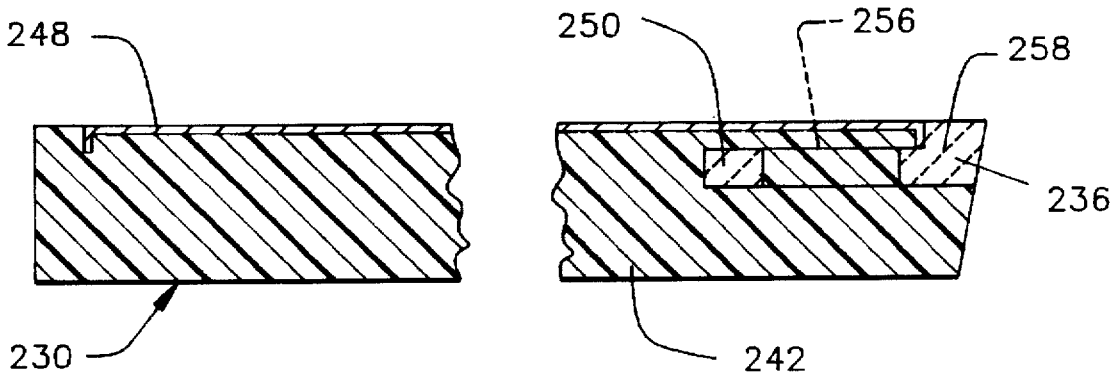
FIG. 18 is cross-sectional view of another embodiment of a composite cutting device in the nature of a bed knife constructed in accordance with the most preferred embodiment of the present invention.
Figure 19:
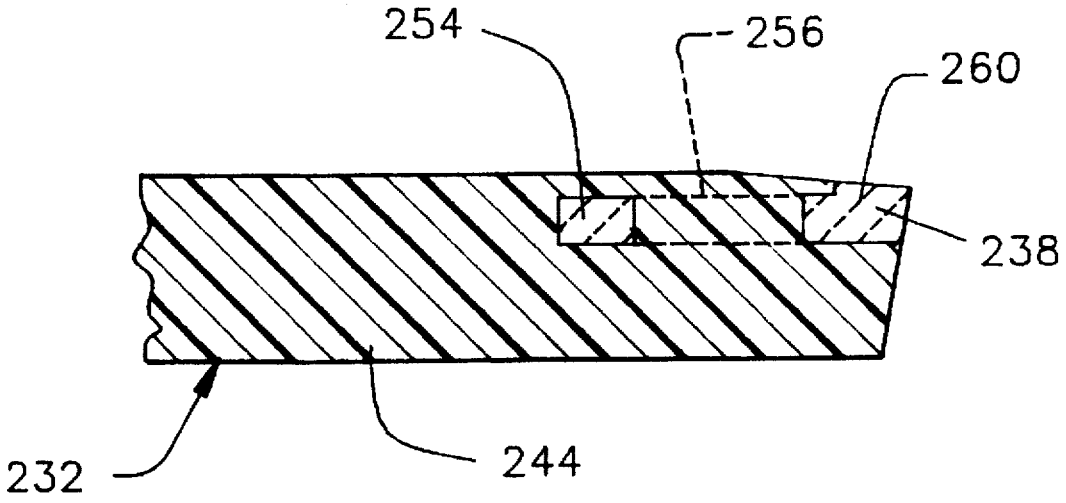
FIG. 19 is cross-sectional view of another embodiment of a composite cutting device in the nature of a bed knife constructed in accordance with the most preferred embodiment of the present invention.
Figure 20:
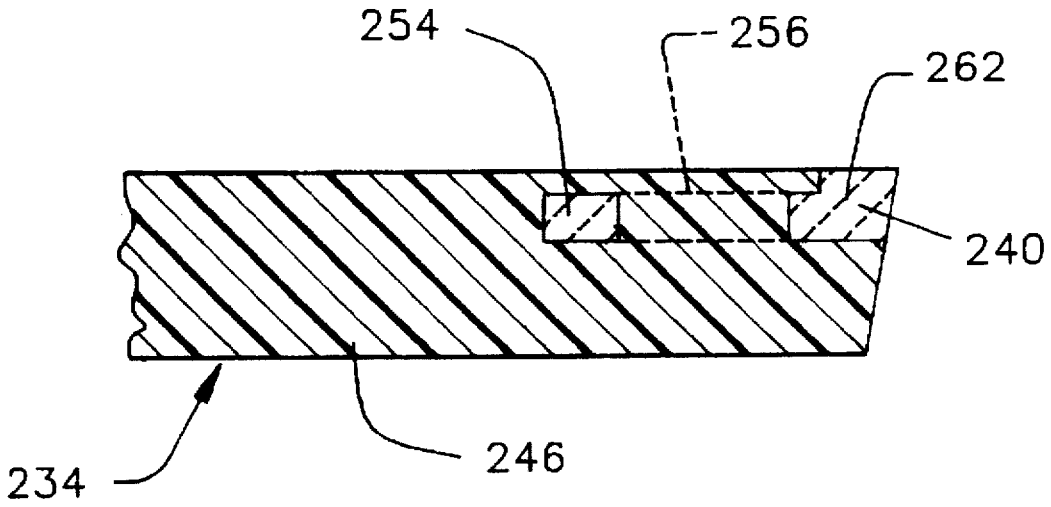
FIG. 20 is cross-sectional view of another embodiment of a composite cutting device in the nature of a bed knife constructed in accordance with the most preferred embodiment of the present invention.

Referring now to FIGS. 18–20, there will be described the most preferred embodiment of the construction of bed knives 230, 232, 234 for use in accordance with the present invention. Each of the bed knives 230, 232, 234 are constructed in a similar manner as previously described with respect to FIGS. 7 and 8. In this regard, the respective cutting blades 236, 238, 240 are embedded in a respective support 242, 244, 246. In FIG. 18, a preformed ceramic plate 248 having a U-shaped cross-section is molecular bonded to the exposed surface of the support 242 as a protective layer. That portion of the plate 248 adjacent the cutting blade 236 may be adhered thereto by molecular bonding. Each of the cutting blades 236, 238, 240, unlike those previously described, have a generally L-shaped profile. The secondary leg 250, 252, 254 of each of the cutting blades 236, 238, 240 is provided with a plurality of spaced openings 256 for securing the cutting blade within its respective support 242, 244, 246 as previously described.

The primary leg 258, 260, 262 of each of the cutting blades 236, 238, 240 is formed as an angled integral extension of the primary leg 250, 252, 254 so as to provide a generally L-shaped profile. This L-shaped profile enables greater exposure of the cutting surfaces of the cutting blades 226, 238, 240 over the previously disclosed embedded cutting blades. The increased exposure of the cutting blades 236, 238, 240 facilitates sharpening of the blade edge as may be required from time to time.

Figure 21:
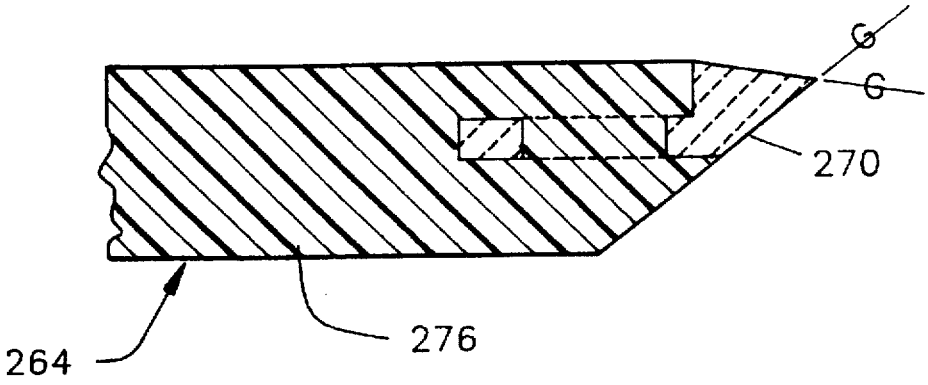
FIG. 21 is cross-sectional view of another embodiment of a composite cutting device in the nature of a fly knife constructed in accordance with the most preferred embodiment of the present invention.
Figure 22:
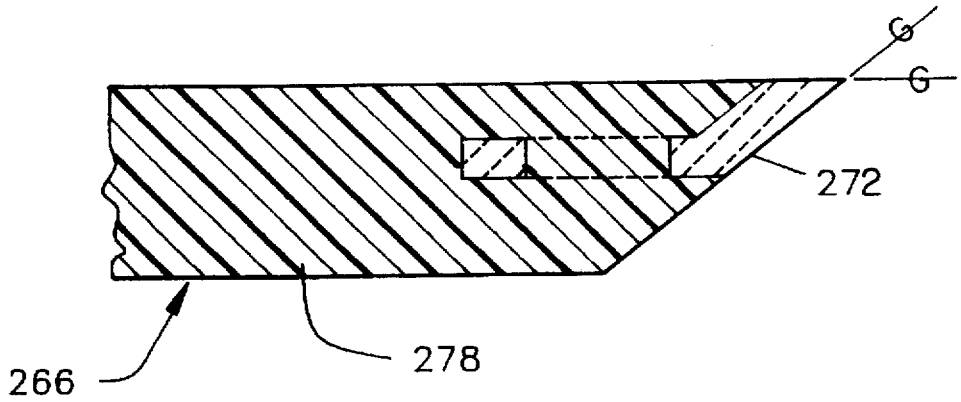
FIG. 22 is cross-sectional view of another embodiment of a composite cutting device in the nature of a fly knife constructed in accordance with the most preferred embodiment of the present invention.
Figure 23:
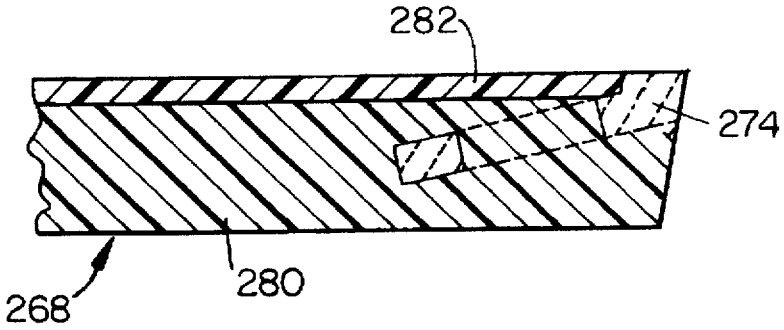
FIG. 23 is cross-sectional view of another embodiment of a composite cutting device in the nature of a fly knife constructed in accordance with the most preferred embodiment of the present invention.

Referring now to FIGS. 21–23, there is disclosed the most preferred embodiment of the construction of fly knives 264, 266, 268 for use in accordance with the present invention. The cutting blades 270, 272, 274 are likewise embedded in a respective support 276, 278, 280 as previously described. Each of the cutting blades also has a generally L-shaped profile to enable greater exposure of the cutting surfaces. As shown in FIG. 23, the support 280 may be provided with a protective layer 282 of either ceramic or composite reinforced polymer material in the manner previously described.

Although the invention herein has been described with reference to particular embodiments, it is to be understood that the embodiments are merely illustrative of the principles and application of the present invention. For example, the housing 102 can be constructed of similar reinforced polymer materials as described and coated with a protective layer of ceramic material to provide a housing which is light in weight, resistant to abrasion, inert to chemical attack and the like. It is therefore to be understood that numerous modifications may be made to the embodiments and that other arrangements may be devised without departing from the spirit and scope of the present invention as defined by the claims.

What is claimed is:

1. A composite cutting device for plastic material comprising a rigid support of polymer material, and a cutting blade of ceramic material having a body supporting portion and a cutting edge portion, said body supporting portion secured to said support.

2. The composite cutting device of claim 1, wherein said polymer material comprises reinforced polymer material.

3. The composite cutting device of claim 1, wherein said cutting blade has a rectangular cross-section.

4. The composite cutting device of claim 1, wherein said body supporting portion of said cutting blade is molecular bonded to said support.

5. The composite cutting device of claim 1, wherein said body supporting portion of said cutting blade is embedded within said support.

6. The composite cutting device of claim 5, wherein said body supporting portion of said cutting blade includes at least one opening extending therethrough, said opening filled with said polymer material thereby securing said cutting blade within said support.

7. The composite cutting device of claim 5, wherein said support comprises a first body of polymer material supporting said body supporting portion of said cutting blade, and a second body of polymer material secured overlying said first body of polymer material and said body supporting portion of said cutting blade, whereby the first and second bodies of polymer material form an integral support having said body supporting portion of said cutting blade embedded therein.

8. The composite cutting device of claim 1, wherein said cutting blade comprises a plurality of cutting blade segments arranged in end-to-end relationship.

9. The composite cutting device of claim 8, wherein said cutting blade segments are linear segments.

10. The composite cutting device of claim 8, wherein said cutting blade segments are curved segments.

11. The composite cutting device of claim 10, wherein said curved segments form a circular cutting blade having a circumferential cutting edge portion.

12. The composite cutting device of claim 8, wherein each of said cutting blade segments are replaceable with another cutting blade segment independent of the remaining cutting blade segments.

13. The composite cutting device of claim 1, wherein said cutting device comprises a bed knife.

14. The composite cutting device of claim 1, wherein said cutting device comprises a fly knife.

15. An apparatus for cutting plastic material, said apparatus comprising a housing; a rotor rotatably mounted within said housing; at least one first cutting device attached to said rotor for rotation therewith, said first cutting device comprising a rigid support of polymer material and a cutting blade of ceramic material having a body supporting portion and a cutting edge portion, said body supporting portion secured to said support; and at least one second cutting device supported within said housing opposing said first cutting device, said second cutting device comprising a rigid support of polymer material and a cutting blade of ceramic material having a body supporting portion and a cutting edge portion, said body supporting portion secured to said support, said cutting edge portion of said first cutting device spaced from said cutting edge portion of said second cutting device to provide a cutting zone therebetween.

16. The apparatus of claim 15, further including inlet means for supplying polymer material to said cutting zone.

17. The apparatus of claim 15, further including a plurality of first cutting devices arranged circumferentially about said rotor.

18. The apparatus of claim 15, wherein said housing is constructed of reinforced polymer material.

19. The apparatus of claim 18, wherein said housing has an inner surface coated with a layer of ceramic material.

20. The apparatus of claim 15, wherein said body supporting portion of at least one of said cutting devices is embedded within said support therefore.

21. The apparatus of claim 20, wherein the embedded body supporting portion of said cutting device includes at least one opening extending therethrough, said opening filled with said polymer material thereby locking said cutting device within said support.

22. The apparatus of claim 20, wherein said support having said body supporting portion embedded therein comprises a first body of polymer material supporting said body supporting portion of said cutting device, and a second body of polymer material secured overlying said first body of polymer material and said body supporting portion of said cutting device, whereby the first and second bodies of polymer material form an integral support having said body supporting portion of said cutting device embedded therein.

23. The apparatus of claim 15, wherein said support of at least one of said cutting devices comprises reinforced polymer material.

24. A cutting apparatus comprising a rotatable cutting device, said cutting device including a circular cutting blade having a plurality of curved cutting blade segments of ceramic material secured to a support therefore of polymer material, said curved cutting blade segments arranged in end-to-end relationship forming said circular cutting blade having a circumferential cutting edge portion and means for rotating said cutting device.

25. The apparatus of claim 24, wherein each of said curved cutting blade segments are replaceable with another cutting blade segment independent of the remaining cutting blade segments.

26. The apparatus of claim 24, wherein said cutting blade includes a rib embedded within said support.

27. The apparatus of claim 26, wherein said rib includes a plurality of openings therein filled with said polymer material.

28. The apparatus of claim 24, wherein said support comprises reinforced polymer material.

29. A composite cutting device for plastic material comprising a first rigid support of reinforced polymer material, said first support having a plurality of projections extending therefrom, and a cutting blade of ceramic material including a body supporting portion having a plurality of openings therein and a cutting edge portion, said body supporting portion arranged on said first support wherein said projections are received within said openings, and a rigid second support of reinforced polymer material bonded to said first rigid support and said projections extending through said openings, whereby said cutting blade is embedded between said first and second rigid supports which form an integral body of reinforced polymer material.

30. The apparatus of claim 29, wherein said rigid first support includes a recessed portion for receiving said body supporting portion of said cutting blade.

* * * * *